US010058188B2

(12) United States Patent
Tarplee et al.

(10) Patent No.: US 10,058,188 B2
(45) Date of Patent: Aug. 28, 2018

(54) MATTRESS FOUNDATION INCLUDING VIBRATION MOTOR ASSEMBLIES

(75) Inventors: Jennifer Lynn Tarplee, Lexington, KY (US); John Brent Conkle, Louisville, KY (US); Thomas Allen Zakowski, Jr., Georgetown, KY (US); George Harry Kormanos, Nashaua, NH (US); Maurice B. Bastarache, Wayland, MA (US); Joshua B. Nudelman, Lynn, MA (US)

(73) Assignee: Tempur-Pedic Management, LLC, Lexington, KY (US)

( * ) Notice: Subject to any disclaimer, the term of this patent is extended or adjusted under 35 U.S.C. 154(b) by 700 days.

(21) Appl. No.: 14/417,568

(22) PCT Filed: Jul. 27, 2012

(86) PCT No.: PCT/US2012/048619
§ 371 (c)(1),
(2), (4) Date: Jun. 26, 2015

(87) PCT Pub. No.: WO2014/018059
PCT Pub. Date: Jan. 30, 2014

(65) Prior Publication Data

US 2015/0305510 A1 Oct. 29, 2015

(51) Int. Cl.
*A47B 7/02* (2006.01)
*A47C 20/04* (2006.01)
(Continued)

(52) U.S. Cl.
CPC ..... *A47C 20/041* (2013.01); *A47C 21/006* (2013.01); *A47C 27/148* (2013.01);
(Continued)

(58) Field of Classification Search
CPC ... A47C 20/041; A47C 21/006; A47C 27/148; A47C 27/16; A47C 27/041;
(Continued)

(56) References Cited

U.S. PATENT DOCUMENTS 5,007,410 A 4/1991 Delaney
5,140,976 A 8/1992 Cheng
(Continued)

FOREIGN PATENT DOCUMENTS

WO PCT-WO 02/062184 A2 8/2002

OTHER PUBLICATIONS

USPTO Written Opinion and Search Report, dated Mar. 26, 2013, 10 pgs.

*Primary Examiner* — Glenn Richman
(74) *Attorney, Agent, or Firm* — Middleton Reutlinger

(57) ABSTRACT

An adjustable mattress foundation includes a frame having at least one movable frame portion, a panel coupled for movement with the movable frame portion, an actuator supported upon the frame and operable to selectively incline the at least one movable frame portion, and a vibration motor assembly coupled to the panel. The vibration motor assembly includes a vibration motor and a cover at least partially enclosing the vibration motor. The cover includes an outer shell and a liner at least partially positioned within the outer shell.

24 Claims, 14 Drawing Sheets

(51) Int. Cl.

| | |
|---|---|
| ***A47C 21/00*** | (2006.01) |
| ***A61H 23/02*** | (2006.01) |
| ***A47C 27/14*** | (2006.01) |
| ***A47C 27/16*** | (2006.01) |
| ***A61G 7/015*** | (2006.01) |
| ***A61H 23/00*** | (2006.01) |

(52) U.S. Cl.
CPC ..... *A47C 27/16* (2013.01); *A61G 7/015* (2013.01); *A61H 23/00* (2013.01); *A61H 23/0254* (2013.01); *A61H 2201/0142* (2013.01); *A61H 2201/5002* (2013.01); *A61H 2205/062* (2013.01); *A61H 2205/081* (2013.01); *A61H 2205/10* (2013.01)

(58) Field of Classification Search
CPC ..... A47C 27/006; A61H 23/0254; A61H 2201/0142; A61H 2201/5002; A61H 2205/062; A61H 2205/081; A61H 2205/10; A61H 23/00; A61G 7/015
See application file for complete search history.

(56) References Cited

U.S. PATENT DOCUMENTS

| | | | |
|---|---|---|---|
| 5,188,096 | A | 2/1993 | Yoo |
| 5,314,403 | A | 5/1994 | Shaw |
| 5,323,499 | A | 6/1994 | Chan |
| 5,344,437 | A | 9/1994 | Pistay |
| 5,361,437 | A | 11/1994 | Zhu et al. |
| 5,374,238 | A | 12/1994 | Xiao |
| 5,393,297 | A | 2/1995 | Kristoff |
| 5,411,468 | A | 5/1995 | Chen |
| 5,416,936 | A | 5/1995 | Chan |
| 5,429,585 | A | 7/1995 | Liang |
| 5,437,608 | A | 8/1995 | Cutler |
| 5,462,515 | A | 10/1995 | Tseng |
| 5,503,618 | A | 4/1996 | Rey |
| 5,539,943 | A | 7/1996 | Romano |
| 5,540,651 | A | 7/1996 | Risch et al. |
| 5,599,280 | A | 2/1997 | Wolden |
| 5,600,214 | A | 2/1997 | Fromson |
| 5,624,155 | A | 4/1997 | Bluen et al. |
| 5,713,832 | A | 2/1998 | Jain |
| 5,771,514 | A | 6/1998 | Wilhoit |
| 5,807,287 | A | 9/1998 | Cheng |
| 5,836,645 | A | 11/1998 | Sakaue et al. |
| 5,836,900 | A | 11/1998 | Leventhal |
| 5,842,241 | A | 12/1998 | Cooper et al. |
| 5,857,986 | A | 1/1999 | Moriyasu |
| 5,865,771 | A | 2/1999 | Shuto et al. |
| 5,868,687 | A | 2/1999 | Tedesco |
| 5,895,365 | A | 4/1999 | Tomlinson |
| 5,951,500 | A | 9/1999 | Cutler |
| 6,024,407 | A | 2/2000 | Eakin |
| 6,027,463 | A | 2/2000 | Moriyasu |
| 6,039,702 | A | 3/2000 | Cutler et al. |
| 6,052,852 | A | 4/2000 | Huang |
| 6,053,880 | A | 4/2000 | Sleichter, III |
| 6,077,238 | A | 6/2000 | Chung |
| 6,106,490 | A | 8/2000 | Shaw |
| 6,110,131 | A | 8/2000 | Sleichter, III et al. |
| 6,120,468 | A | 9/2000 | Tseng |
| 6,142,963 | A | 11/2000 | Black et al. |
| 6,170,602 | B1 | 1/2001 | Mann |
| 6,175,981 | B1 | 1/2001 | Lizama et al. |
| 6,178,577 | B1 | 1/2001 | Chien-Chuan |
| 6,182,313 | B1 | 2/2001 | Eschenbach |
| 6,256,818 | B1 | 7/2001 | Hughes |
| 6,290,661 | B1 | 9/2001 | Cutler et al. |
| 6,375,630 | B1 | 4/2002 | Cutler et al. |
| 6,438,779 | B1 | 8/2002 | Brown |
| 6,440,092 | B1 | 8/2002 | Leventhal et al. |
| 6,499,161 | B1 | 12/2002 | Godette |
| 6,517,500 | B2 | 2/2003 | Ichikawa |
| 6,524,263 | B2 | 2/2003 | Chen |
| 6,626,341 | B2 | 9/2003 | Mitchell |
| 6,647,572 | B2 | 11/2003 | Lee |
| 6,648,840 | B2 | 11/2003 | Cutler et al. |
| 6,676,615 | B2 | 1/2004 | Flick et al. |
| 6,682,494 | B1 | 1/2004 | Sleichter, III et al. |
| 6,682,495 | B2 | 1/2004 | Park |
| 6,684,423 | B2 | 2/2004 | Godette |
| 6,723,059 | B1 | 4/2004 | Park |
| 6,785,922 | B2 | 9/2004 | Bretschger et al. |
| 6,814,709 | B2 | 11/2004 | Schwartz et al. |
| 6,826,789 | B1 | 12/2004 | Choi |
| 6,829,797 | B2 | 12/2004 | Partian |
| 6,849,054 | B1 | 2/2005 | Kim |
| 6,851,146 | B1 | 2/2005 | Kristof et al. |
| 6,890,313 | B2 | 5/2005 | Kim |
| 6,957,454 | B1 | 10/2005 | Newton |
| 6,968,806 | B2 | 11/2005 | Helwig |
| 7,013,588 | B2 | 3/2006 | chang |
| 7,037,279 | B2 | 5/2006 | Kim |
| 7,048,701 | B2 | 5/2006 | Kim |
| 7,052,475 | B2 | 5/2006 | Kim |
| 7,108,667 | B1 | 9/2006 | Turudich |
| 7,118,541 | B2 | 10/2006 | Kim |
| 7,127,075 | B2 | 10/2006 | Park |
| 7,228,573 | B2 | 6/2007 | Smith |
| 7,322,058 | B2 | 1/2008 | Long |
| 7,322,947 | B2 | 1/2008 | Flick et al. |
| 7,328,470 | B2 | 2/2008 | Harris, Jr. et al. |
| 7,356,862 | B2 | 4/2008 | Hsieh |
| 7,361,152 | B2 | 4/2008 | Sanada et al. |
| 7,546,653 | B2 | 6/2009 | Ye |
| 7,549,966 | B2 | 6/2009 | Fujii et al. |
| 7,553,288 | B2 | 6/2009 | Cohen |
| 7,614,099 | B2 | 11/2009 | Goetz |
| 7,681,949 | B2 | 3/2010 | Nathan et al. |
| 7,712,172 | B2 | 5/2010 | Jones |
| 7,717,868 | B2 | 5/2010 | Inada et al. |
| 7,725,962 | B1 | 6/2010 | Smith |
| 7,727,171 | B2 | 6/2010 | Ozaki et al. |
| 7,771,375 | B2 | 8/2010 | Nishibori et al. |
| 7,905,846 | B2 | 3/2011 | Ganti |
| 7,918,308 | B2 | 4/2011 | Cohen |
| 7,988,649 | B1 | 8/2011 | Kost |
| 8,038,632 | B2 | 10/2011 | Flick et al. |
| 8,043,238 | B1 | 10/2011 | Tamura et al. |
| 8,185,986 | B2 * | 5/2012 | Grimes ..... A61H 1/005 5/600 |
| 9,498,068 | B2 * | 11/2016 | Lee ..... A61H 23/0254 |
| 9,526,665 | B2 * | 12/2016 | Rawls-Meehan ..... A61H 23/04 |
| 9,730,525 | B2 * | 8/2017 | Rawls-Meehan .... A47C 20/041 |
| 2002/0111572 | A1 | 8/2002 | Waters |
| 2002/0115946 | A1 | 8/2002 | Cutler et al. |
| 2003/0028132 | A1 | 2/2003 | Bastia et al. |
| 2005/0015027 | A1 | 1/2005 | Kojima |
| 2005/0070827 | A1 | 3/2005 | Lee |
| 2006/0037146 | A1 | 2/2006 | Heng |
| 2006/0058713 | A1 | 3/2006 | Lee |
| 2007/0213646 | A1 | 9/2007 | Han |
| 2008/0033326 | A1 | 2/2008 | Evans |
| 2008/0033327 | A1 | 2/2008 | Evans et al. |
| 2010/0262050 | A1 | 10/2010 | Gasparovich |
| 2012/0167311 | A1 | 7/2012 | Lee |

* cited by examiner

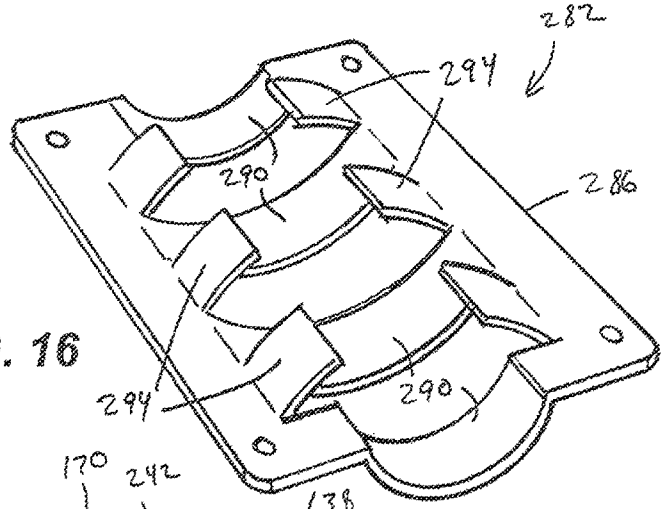
FIG. 16
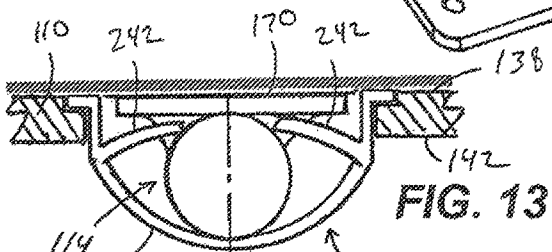
FIG. 13
FIG. 15
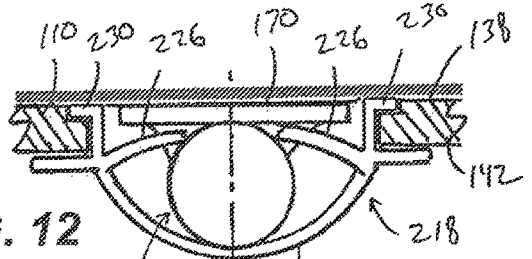
FIG. 12
FIG. 14

MATTRESS FOUNDATION INCLUDING VIBRATION MOTOR ASSEMBLIES

FIELD OF THE INVENTION

The present invention relates to mattress foundations, and more particularly to vibration devices and methods for mattress foundations.

BACKGROUND OF THE INVENTION

Adjustable mattress foundations are utilized to vary the shape of a mattress supported thereon in accordance with a user's comfort level. Such foundations are operable, for example, to incline a portion of the mattress associated with the user's head and shoulders, and another portion of the mattress associated with the user's legs and feet. Vibration motors are also typically utilized with adjustable mattress foundations to impart massaging vibrations to portions of the mattress associated with the user's back and legs.

SUMMARY OF THE INVENTION

The present invention provides, in one aspect, an adjustable mattress foundation including a frame having, at least one movable frame portion, a panel coupled for movement with the movable frame portion, an actuator supported upon the frame and operable to selectively incline the at least one movable frame portion, and a vibration motor assembly coupled to the panel. The vibration motor assembly includes a vibration motor and a cover at least partially enclosing the vibration motor. The cover includes an outer shell and a liner at least partially positioned within the outer shell.

In some embodiments, the invention provides an assembly for generating vibration of a mattress supported upon a panel of a mattress foundation, the panel having an aperture therein, the assembly comprising a vibration motor; and a cover at least partially enclosing the vibration motor, the cover coupled to the panel and suspending the vibration motor in a position substantially aligned with the aperture in the panel and located at least partially below the panel, the cover comprising an outer shell adapted to be coupled to the panel proximate the aperture; and a liner at least partially positioned within the outer shell between the vibration motor and the outer shell.

Some embodiments of the present invention provide a mattress foundation comprising a frame; a panel supported by the frame and adapted for support of a mattress thereon; and a vibration motor assembly coupled to the panel, the vibration motor assembly including a vibration motor and a cover at least partially enclosing the vibration motor, the cover including an outer shell and a liner at least partially positioned within the outer shell.

Other features and aspects of the invention will become apparent by consideration of the following detailed description and accompanying, drawings.

BRIEF DESCRIPTION OF THE DRAWINGS

FIG. 12 is a front view of yet another alternative embodiment of the vibration motor assembly of FIG. 7.

FIG. 13 is a front view of a further alternative embodiment of the vibration motor assembly of FIG. 7.

FIG. 14 is a front view of another alternative embodiment of the vibration motor assembly of FIG. 7.

FIG. 15 is a front view of yet, another alternative embodiment of the vibration motor assembly of FIG. 7.

FIG. 16 is a top perspective view of yet another alternative embodiment of the vibration motor assembly of FIG. 7, with the vibration motor omitted for clarity.

Before any embodiments of the invention are explained in detail, it is to be understood that the invention is not limited in its application to the details of embodiment and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
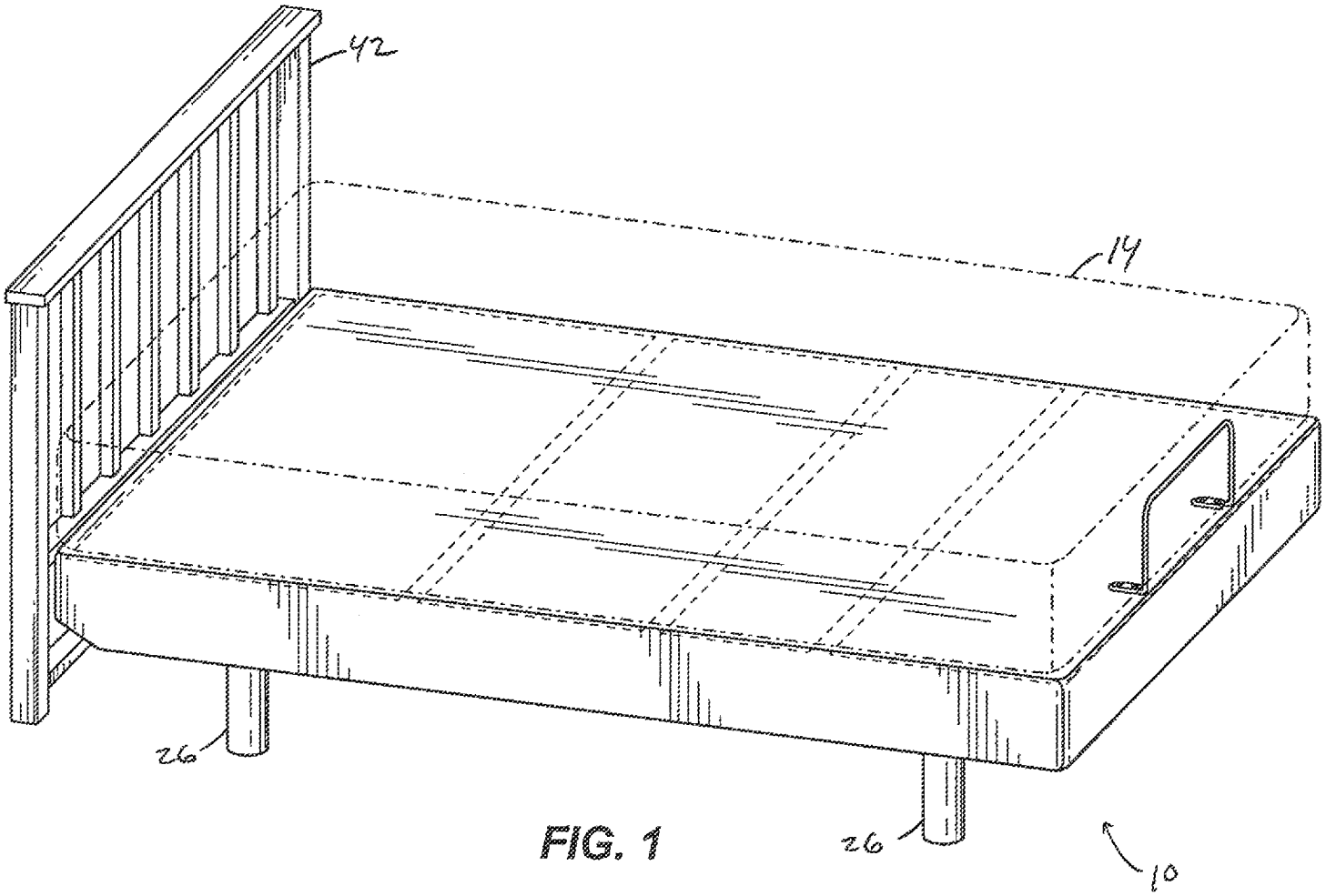
FIG. 1 is a perspective view of an adjustable mattress foundation of the invention, with a mattress supported thereon, in a flat configuration.
Figure 2:
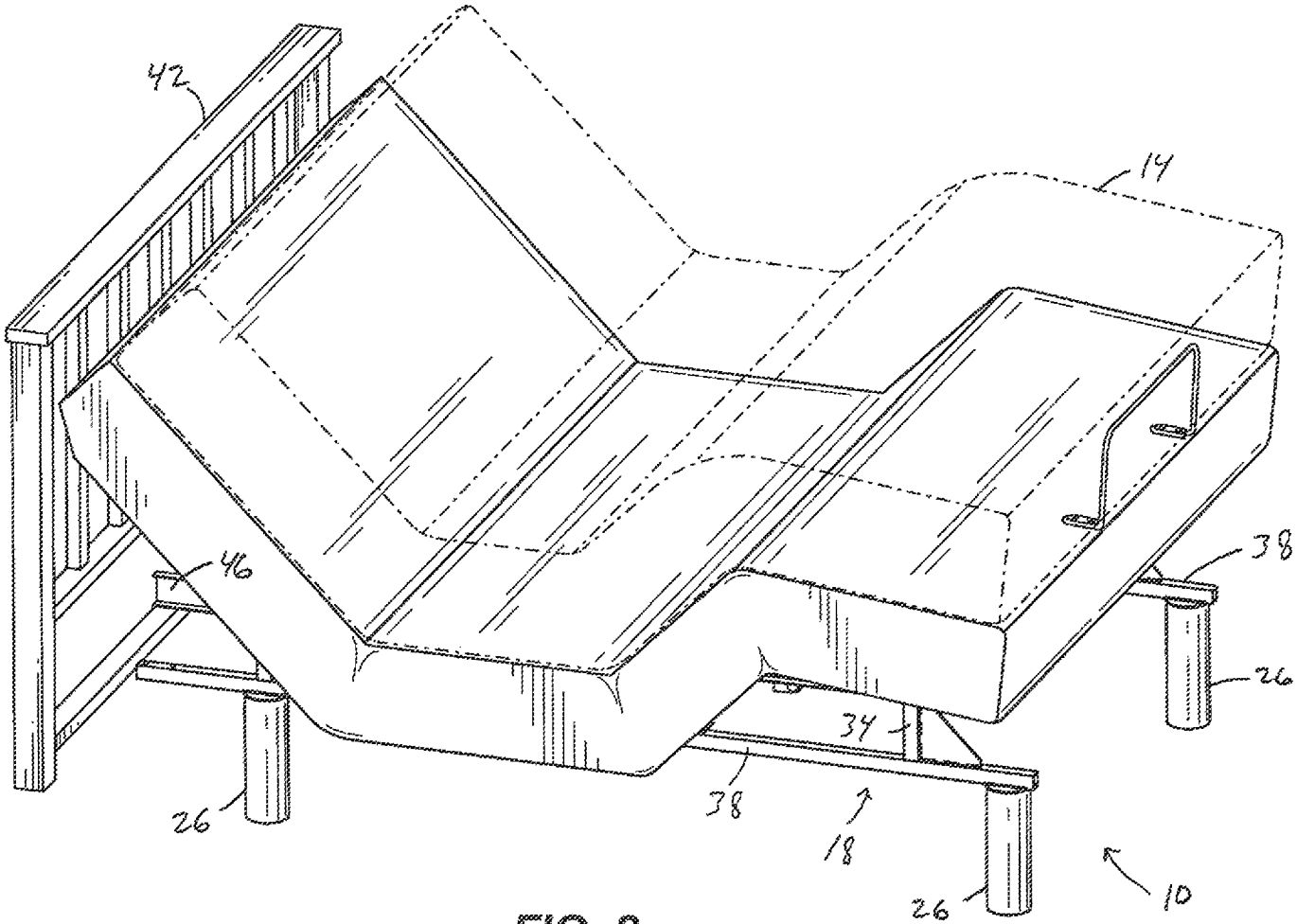
FIG. 2 is a perspective view of the adjustable mattress foundation of FIG. 1 in an inclined or raised configuration.

FIGS. 1 and 2 illustrate an adjustable mattress foundation 10 that is reconfigurable between a flat configuration for supporting a mattress 14 thereon in a flat orientation (FIG. 1), and an inclined or raised configuration for supporting the mattress 14 in an inclined or raised orientation (FIG. 2). It should also be understood that the foundation 10 can be adjustable to any of a number of partially inclined or raised configurations between the flat and raised configurations shown in FIGS. 1 and 2, respectively, depending upon user preference and comfort.

Figure 3:
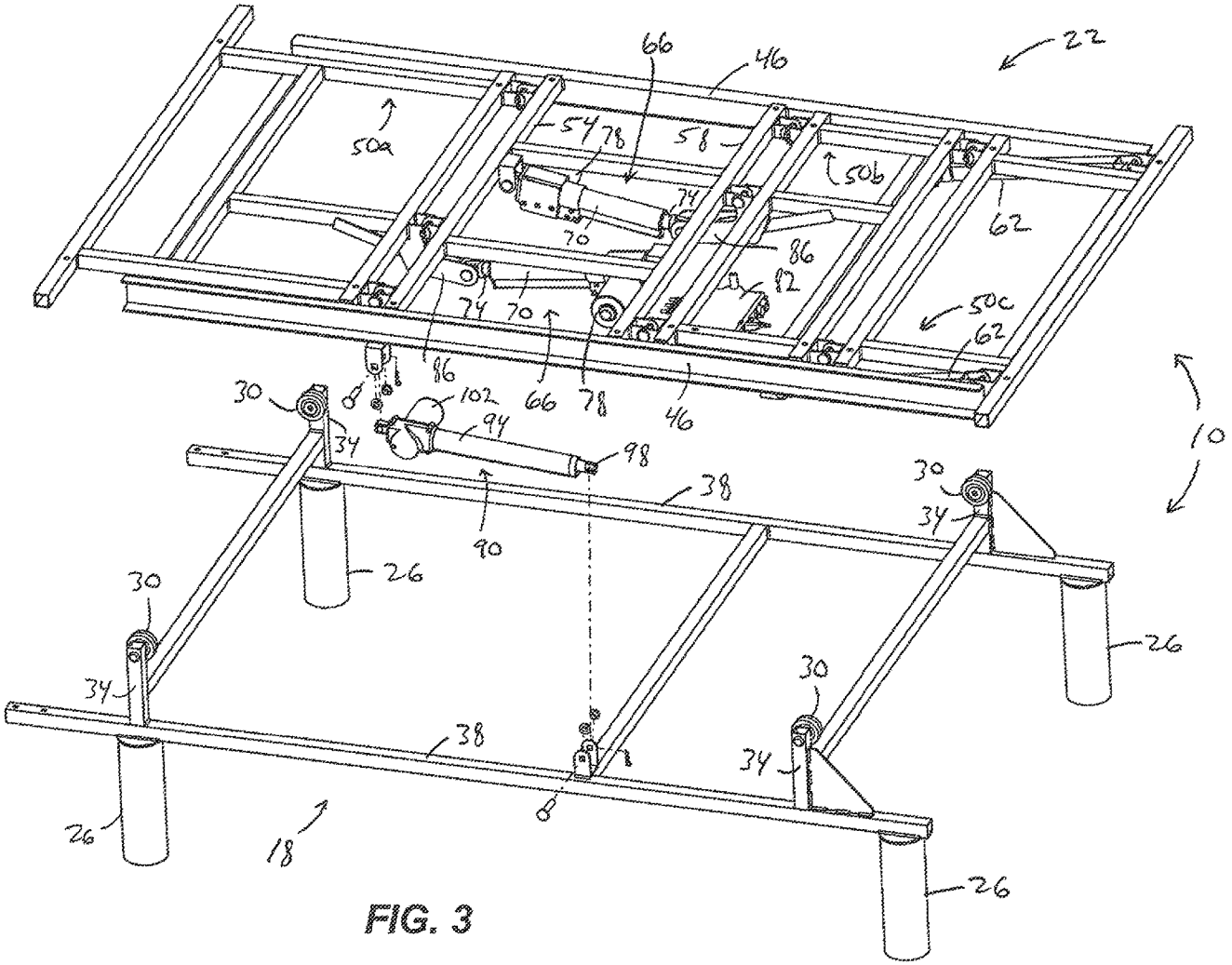
FIG. 3 is an exploded, top perspective view of the adjustable mattress foundation of FIG. 1.

With reference to FIG. 3, the illustrated adjustable mattress foundation 10 includes a first or lower frame 18 and a second or upper frame 22 supported upon the lower frame 18. The lower frame 18 includes four posts 26 for supporting, the foundation 10 on a support surface (e.g., a floor) and four rollers 30 facing the interior of the lower frame 18. The rollers 30 are rotatably supported upon four uprights 34 which, in turn, are fixed (e.g., by welding, fasteners, or in any other suitable manner) to parallel longitudinal rails 38 of the lower frame 18. A headboard 42 (FIGS. 1 and 2) may be coupled to the longitudinal rails 38 in a conventional manner.

The upper frame 22 includes spaced, parallel guide rails 46 in which the rollers 30 are received to support the upper frame 22 upon the lower frame 18 (FIG. 3). As such, the rollers 30 permit the upper frame 22 to be axially or longitudinally displaced relative to the lower frame 18 and the headboard 42 as the foundation 10 transitions between the flat configuration shown in FIG. 1 and the inclined or raised configuration shown in FIG. 2. With reference to FIG. 3, the upper frame 22 includes first, second, and third movable frame portions 50*a*, 50*b*, 50*c* to achieve the inclined or raised orientation of the mattress 14 shown in FIG. 2, although fewer or more frame portions can be utilized in other embodiments. The first movable frame portion 50*a* coincides with a portion of the mattress 14 upon which a user's head and upper body is supported (FIG. 3). The first movable frame portion 50*a* is pivotably coupled to a cross-beam 54 interconnecting the guide sails 46, such that the first movable frame portion 50*a* is pivotable about an axis transverse to the guide rails 46.

The second movable frame portion 50*b* coincides with a portion of the mattress 14 upon which the user's upper legs or thighs are supported. The second movable frame portion 50*b* is pivotably coupled to another cross-beam 58 interconnecting the guide rails 46, such that the second movable frame portion 50*b* is also pivotable about an axis transverse to the guide rails 46. The third movable frame portion 50*c* coincides with a portion of the mattress 14 upon which the user's lower legs and feet are supported. The third movable frame portion 50*c* is pivotably coupled to the second movable frame portion 50*b* about an axis transverse to the guide rails 46. The third movable frame portion 50*c* is also pivotably coupled to the guide rails 46 via respective links 62 (see also FIG. 5). As such, a combination of the guide rails 46, the second and third movable frame portions 50*b*, 50*c*, and the links 62 defines or mimics a four-bar linkage.

With reference to FIG. 3, the adjustable mattress foundation 10 also includes two actuators 66 supported upon the upper frame 22 and operable to selectively incline or raise the first and second movable frame portions 50*a*, 50*b*, respectively. In the illustrated embodiment of the adjustable mattress foundation 10, each of the actuators 66 includes a housing 70, an extensible rack 74 contained within the housing 70, and a servo motor 78 drivably coupled to the rack 74 to linearly displace the rack 74 between extended and retracted positions. The adjustable mattress foundation 10 also includes a controller 82 electrically connected with the servo motors 78 of the respective actuators 66 for selectively activating the servo motors 78 to either extend or retract the racks 74 of the respective actuators 66. Alternatively, the actuators 66 may be configured for use with a pneumatic or hydraulic power source. The actuators 66 can take other forms capable of actuating the frame portions 50*a*, 50*b*, including without limitation lead screw, screw jack, ball screw, and roller screw linear actuators, linear motors, adjustable pneumatic or hydraulic cylinders, and the like.

In the illustrated embodiment of the adjustable mattress foundation 10, the housings 70 of the respective actuators 66 are pivotably coupled to the cross-beams 54, 58 of the upper frame 22, while the respective racks 74 are pivotably coupled to levers 86 which, in turn, extend from the first and second movable frame portions 50*a*, 50*b*, respectively. The levers 86 can each form a bell crank, and can provide increased leverage on the first and second movable frame portions 50*a*, 50*b* to reduce the amount of torque the servo motors 78 must exert to extend the respective racks 74 of the actuators 66 to incline or raise the first and second movable frame portions 50*a*, 50*b*. Alternatively, the orientation of each of the actuators 66 may be reversed such that the housings 70 are pivotably coupled to the respective levers 86 and the racks 74 are pivotably coupled to the cross-beams 54, 58, respectively.

With continued reference to FIG. 3, the adjustable mattress foundation 10 further includes another actuator 90 interconnecting the lower and upper frames 18, 22 and that is independently operable from the actuators 66 to displace the upper frame 22 relative to the lower frame 18. The actuator 90 can take any of the forms described above in connection with the earlier-described actuators 66. Like the other actuators 66, the illustrated actuator 90 includes a housing 94, an extensible rack 98 contained within the housing 94, and a servo motor 102 drivably coupled to the rack 98 to linearly displace the rack 98 between extended and retracted positions. The controller 82 is also electrically connected with the servo motor 102 for selectively activating the servo motor 102 to either extend or retract the rack 98.

In the illustrated embodiment of the adjustable mattress foundation 10, the actuator housing 94 is pivotably coupled to one of the guide rails 46 of the upper frame 22 while the rack 98 is pivotably coupled to one of the longitudinal rails 38 of the lower frame 18. Particularly, the actuator 90 is pivotably coupled to both the right-side rails 38, 46 from the frame of reference of FIG. 3. As such, the actuator 90 can be oriented substantially parallel with the guide rails 46 and the longitudinal rails 38, and is positioned between the right-side guide and longitudinal rails 46, 38. Alternatively, the orientation of the actuator 90 may be reversed such that the housing 94 is pivotably coupled to the lower frame 18 and the rack 98 is pivotably coupled to the upper frame 22. Also, the actuator 90 may instead be positioned in-board or out-board of both the guide and longitudinal rails 46, 38, in other embodiments. Further, the actuator 90 may alternatively be positioned near the left-side guide and longitudinal rails 46, 38 in any of the manners just described. Also, the actuator 90 may alternatively be positioned and coupled between any of the members interconnecting the guide rails 46 and the longitudinal rails 38 while still performing the same actuation function of moving the upper frame 22 to different positions with respect to the lower frame 18 as will now be described.

Figure 4:
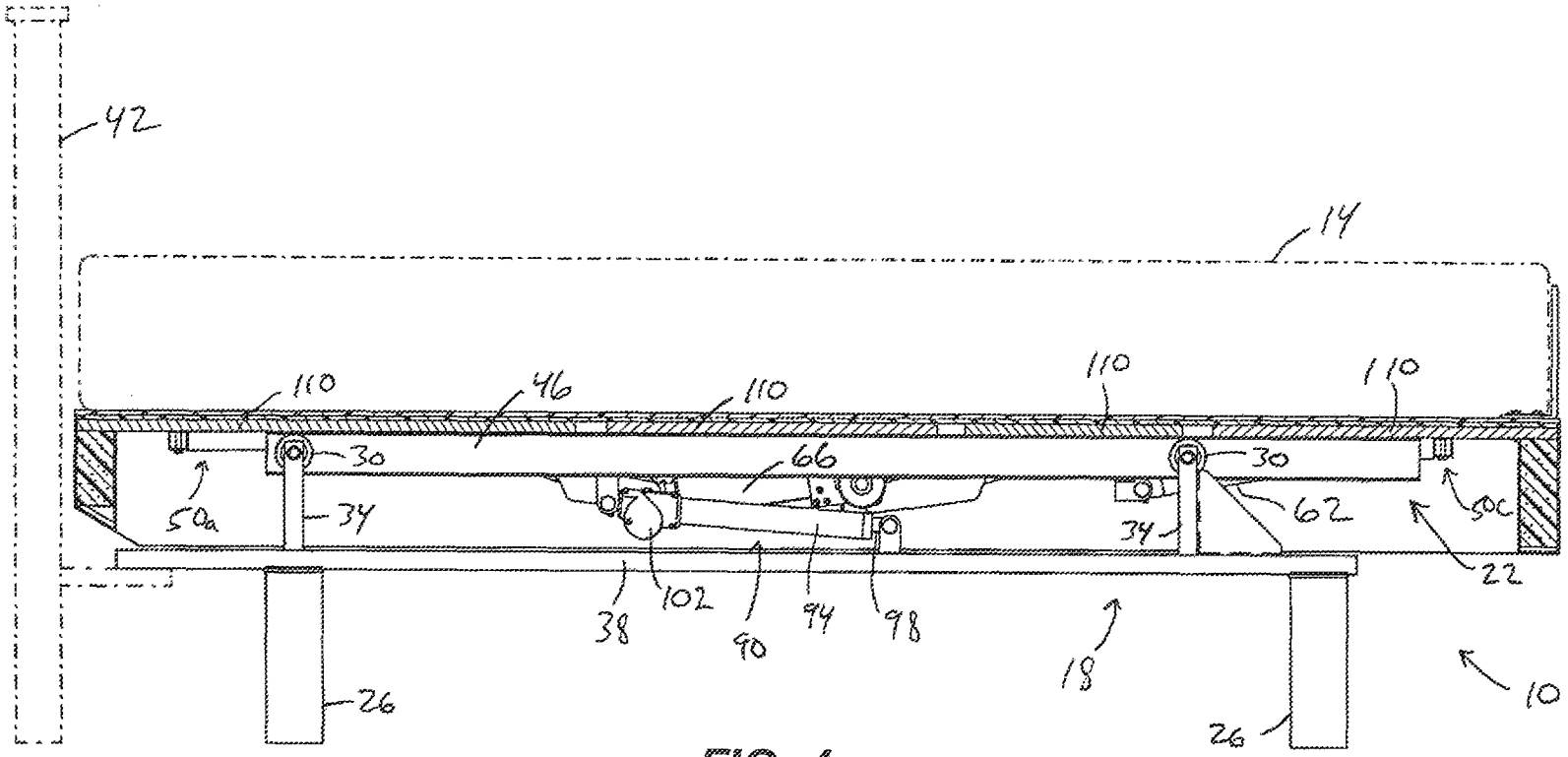
FIG. 4 is a cutaway side view of the adjustable mattress foundation of FIG. 1 in the flat configuration.
Figure 5:
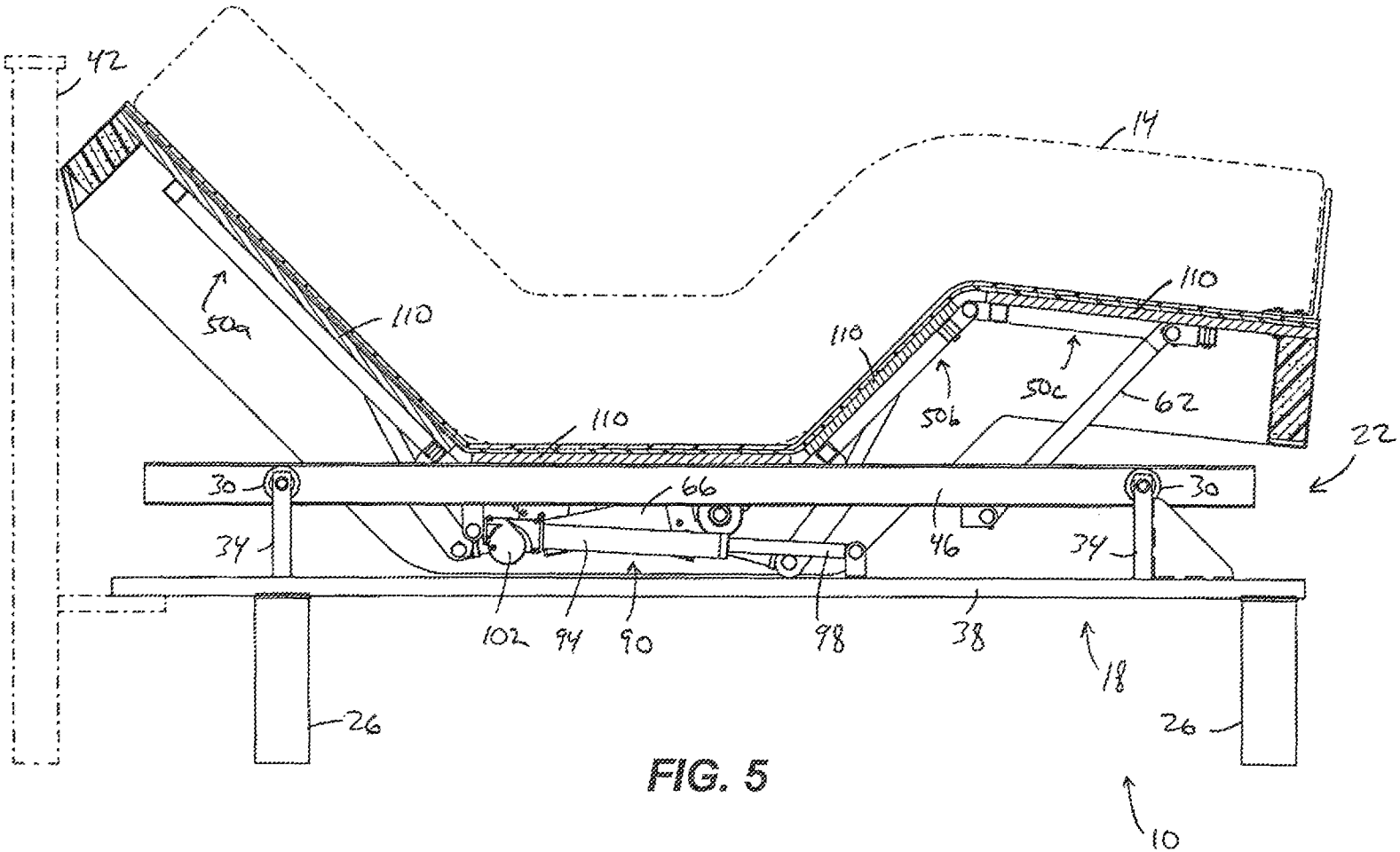
FIG. 5 is a cutaway side view of the adjustable mattress foundation of FIG. 1 in the inclined or raised configuration.

In operation of the adjustable mattress foundation 10, the controller 82 is operable to coordinate inclination or raising of the movable frame portions 50*a*, 50*b*, 50*c* with displacement of the upper frame 22 toward the headboard 42 to generally maintain the axial gap or spacing between the headboard 42 and the upper frame 22 as the foundation 10 transitions from the flat configuration shown in FIGS. 1 and 4 to the inclined or raised configuration shown in FIGS. 2 and 5. As such, the axial or longitudinal position of the user's head remains relatively unchanged, or minimally changed, with respect to the headboard 42 when the foundation 10 transitions from the flat configuration to the inclined or raised configuration.

When the adjustable mattress foundation 10 is initially in the flat configuration shown in FIG. 4, the user may prompt the controller 82 to initiate inclining or raising of the first movable frame portion 50*a* (e.g., by depressing one or more buttons on a user interface, not shown). The controller 82, in turn, concurrently activates the actuator 66 associated with the first movable frame portion 50*a* as well as the actuator 90 for moving the upper frame 22 to different positions with respect to the lower frame 18. Depending upon user input or upon the manner in which the controller 82 is configured, the controller 82 may also activate the actuator 66 associated with the second and third movable frame portions 50*b*, 50*c*. By actuating the actuator 90 along with the actuator 66 associated with the movable frame portion 50*a*, the movable frame portions 50*a* can be inclined while the upper frame 22 is displaced relative to the lower frame 18. In some embodiments, the movable frame portions 50*b*, 50*c* can also or instead be inclined by their respective actuator 66 while the upper frame 22 is displaced relative to the lower frame 18 by the actuator 90. By actuating the actuator 90 along with the actuator 66 associated with the movable frame portion 50*a*, the movable frame portion 50*a* can be inclined while the upper frame 22 is displaced relative to the lower frame 18. Particularly, the controller 82 activates the servo motor 78 of the actuator 66 associated with the first movable frame portion 50*a* to extend the rack 74, thereby inclining the first movable frame portion 50*a* and the corresponding portion of the mattress 14 supported thereon. The controller 82 can activate the servo motor of the actuator 66 associated with the second and third movable frame portions 50*b*, 50*c* to extend the rack 74, thereby inclining the second and third movable frame portions 50*b*, 50*c* and the corresponding portions of the mattress 14 supported thereon.

Concurrently with inclining movement of the first frame portion 50*a* as just, described (and in some embodiments, also or instead with movement of the second and third frame portions 50*b*, 50*c*), the controller 82 activates the servo motor 102 of the actuator 90 to extend the rack 98. In those cases where the first movable frame portion 50*a* is inclined as just described, the concurrent activation of the servo motor 102 of the actuator 90 displaces the upper frame 22 toward the headboard 42 (FIG. 5). Similarly, in some embodiments in those cases where the second and third movable frame portions 50*b*, 50*c* are inclined as just described, the concurrent activation of the servo motor 102 of the actuator 90 also displaces the upper frame 22, such as toward a footboard (not shown). In some embodiments, the controller 82 is configured so that the servo motor 102 of the actuator 90 is not activated (to displace the upper frame 22 with respect to the lower frame 18) if only the second and third movable frame portions 50*b*, 50*c* have been inclined, or is configured so that the servo motor 102 of the actuator 90 is not activated (to displace the upper frame 22 with respect to the lower frame 18) if only the first movable frame portion 50*a* has been inclined. However, it will be appreciated that in many applications, it is desirable that the actuator 90 is activated to displace the upper frame 22 toward the headboard end of the lower frame 18 if the first movable frame portion 50*a* has been inclined in order to perform a "wall-hugging" motion.

When the adjustable mattress foundation 10 is initially in the inclined or raised configuration shown in FIG. 5, the user may prompt the controller 82 to initiate reclining or lowering of the first movable frame portion 50*a* (e.g., by depressing one or more buttons on the user interface, not shown). The controller 82, in turn, concurrently activates the actuator 66 associated with the first movable frame portion 50*a* as well as the actuator 90 for moving the upper frame 22 to different positions with respect to the lower frame 18. Depending upon user input or upon the manner in which the controller 82 is configured, the controller 82 may also activate the actuator 66 associated with the second and third movable frame portions 50*b*, 50*c*. By actuating the actuator 90 along with the actuator 66 associated with the movable frame portion 50*a*, the movable frame portion 50*a* can be reclined while the upper frame 22 is displaced relative to the lower frame 18. In some embodiments, the movable frame portions 50*b*, 50*c* can also or instead be reclined by their respective actuator 66 while the upper frame 22 is displaced relative to the lower frame 18 by the actuator 90. By actuating the actuator 90 along with the actuator 66 associated with the movable frame portion 50*a*, the movable frame portion 50*a* can be reclined while the upper frame 22 is displaced relative to the lower frame 18. Particularly, the controller 82 activates, the servo motor 78 of the actuator 66 associated with the first movable frame portion 50*a* to retract the rack 74, thereby reclining the first movable frame portion 50*a* and the corresponding portion of the mattress 14 supported thereon. The controller 82 can activate the servo motor of the actuator 66 associated with the second and third movable frame portions 50*b*, 50*c* to retract the rack 74, thereby reclining the second, and third movable frame portions 50*b*, 50*c* and the corresponding portions of the mattress 14 supported thereon.

Concurrently with the reclining movement of the first frame portion 50*a* as just described (and in some embodiments, also or instead with movement of the second and third frame portions 50*b*, 50*c*), the controller 82 activates the servo motor 102 of the actuator 90 to retract the rack 98. In those cases where the first movable frame portion 50*a* is reclined as just described, the concurrent activation of the servo motor 102 of the actuator 90 displaces the upper frame 22 away from the headboard 42. Similarly, in some embodiments in those cases where the second and third movable frame portions 50*b*, 50*c* are reclined as just described, the concurrent activation of the servo motor 102 of the actuator 90 also displaces the upper frame 22, such as away from a footboard (not shown). In some embodiments, the controller 82 is configured so that the servo motor 102 of the actuator 90 is not activated (to displace the upper frame 22 with respect to the lower frame 18) if only the second and third movable frame portions 50*b*, 50*c* have been reclined, or is configured so that the servo motor 102 of the actuator 90 is not activated (to displace the upper frame 22 with respect to the lower frame 18) if only the first movable frame portion 50*a* has been reclined. However, it will be appreciated that in many applications, it is desirable that the actuator 90 is activated to displace the upper frame 22 away from the headboard end of the lower frame 18 if the first movable frame portion 50*a* has been reclined in order to perform a "wall-hugging" motion.

Rather than coordinating concurrent operation of the actuators 66, 90 in an inclining operation of the foundation 10 as described herein, the controller 82 may activate the actuator 90 only after the first movable frame portions 50 is fully inclined to displace the upper frame 22 relative to the headboard 42 and lower frame 18. Similarly, rather than coordinating concurrent operation of the actuators 66, 90 in a reclining operation of the foundation as described herein, the controller 82 may activate the actuator 90 before the first movable frame portion 50*a* is declined to displace the upper frame 22 relative to the headboard 42 and lower frame 18.

Figure 6:
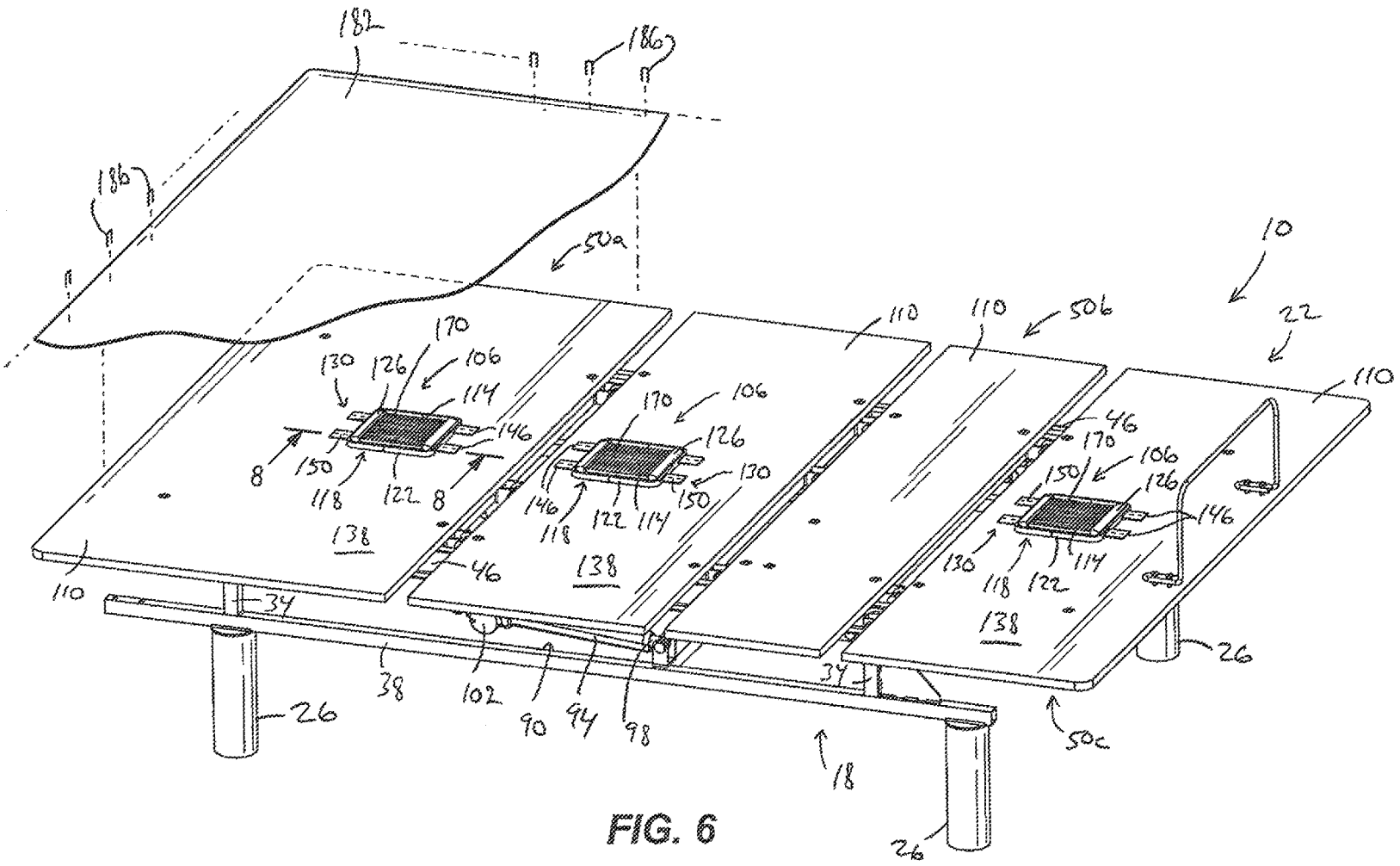
FIG. 6 is a top perspective view of the adjustable mattress foundation of FIG. 1, with portions removed, illustrating three vibration motor assemblies.

With reference to FIG. 6, the illustrated adjustable mattress foundation 10 includes three vibration motor assemblies 106 suspended from respective panels 110 attached to the first movable frame portion 50*a*, the two fixed cross-beams 54, 58 of the upper frame 22, and the third movable frame portion 50*c*. The vibration motor assemblies 106, when activated, impart massaging vibrations to the upper body, the waist, or hips, and the lower legs of a user supported upon the mattress 14. Although three vibration motor assemblies 106 are in the particular locations just described, it will be appreciated that fewer or more vibration motor assemblies 106 can be provided in any locations on any of the panels 110 of the mattress foundation 10, and that multiple vibration motor assemblies 106 can be suspended at different locations on the same panel 110, in some embodiments.

Figure 7:
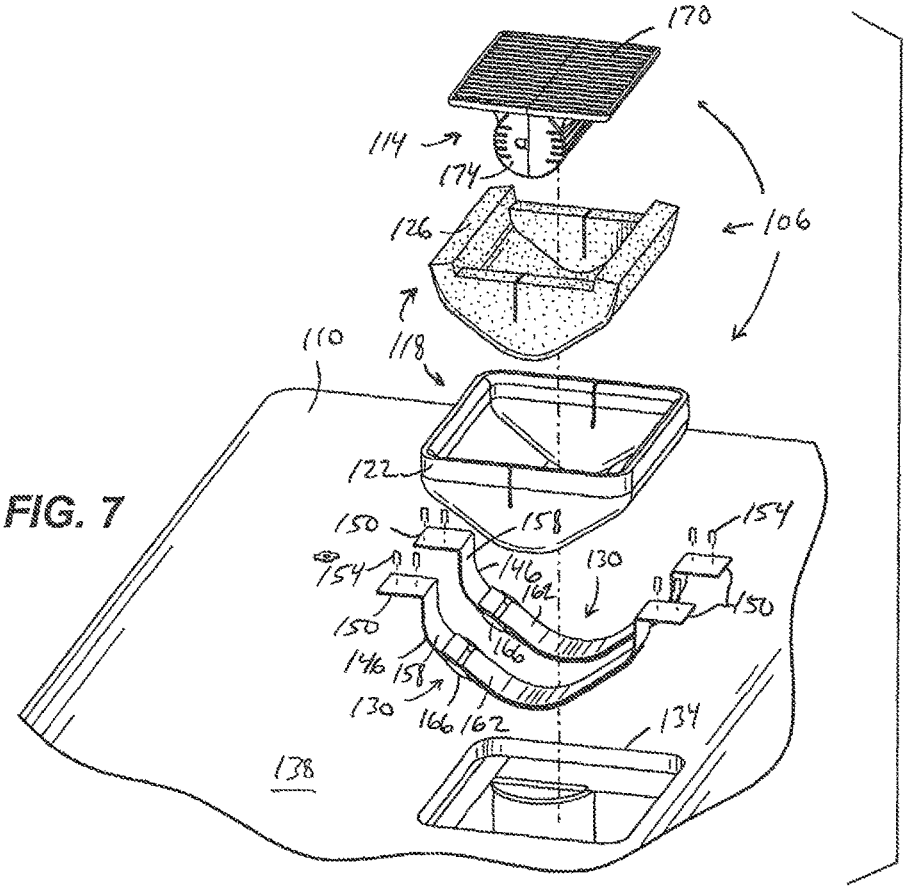
FIG. 7 is an enlarged, exploded perspective view of one of the vibration motor assemblies of FIG. 6.

With reference to FIG. 7, each vibration motor assembly 106 includes a vibration motor 114 and a cover 118 at least partially enclosing the vibration motor 114. In the illustrated embodiment of the vibration motor assembly 106, the cover 118 includes an outer shell 122 and a liner 126 at least partially positioned or nested within the outer shell 122 and disposed between the vibration motor 114 and the outer shell 122. In the illustrated embodiment of the vibration motor assembly 106, the liner 126 is adhesively coupled to the outer shell 122 to unitize the liner 126 and outer shell 122. Alternatively, the liner 126 may be loosely retained or positioned within the outer shell 122.

The outer shell 122 and the liner 126 are each made of foam material. However, the foam material of the outer shell 122 has a different density and hardness than that of the liner 126. In some alternative embodiments, the foam material of the outer shell 122 has substantially the same density or substantially the same hardness as that of the liner 126. In the illustrated embodiment, the outer shell 122 is made of a more rigid and dense foam material (e.g., a closed-cell polymer foam), while the liner 126 is made of a less rigid and dense foam material (e.g., an open-cell polymer foam). The outer shell 122 and liner 126 work in conjunction to attenuate the magnitude of noise emitted by the vibration motor 114 and to attenuate the magnitude of vibration transferred from the vibration motor 114 to the particular panel 110 from which the vibration motor assembly 106 is suspended. Separately, the foam material chosen for the liner 126 includes vibration-attenuation properties that yield most of the vibration-attenuation capability of the cover 118, while the foam material chosen for the outer shell 122 includes noise-attenuation properties that yield most, of the noise-attenuation capability of the cover 118 while providing a degree of structural rigidity to the cover 118.

Figure 8:
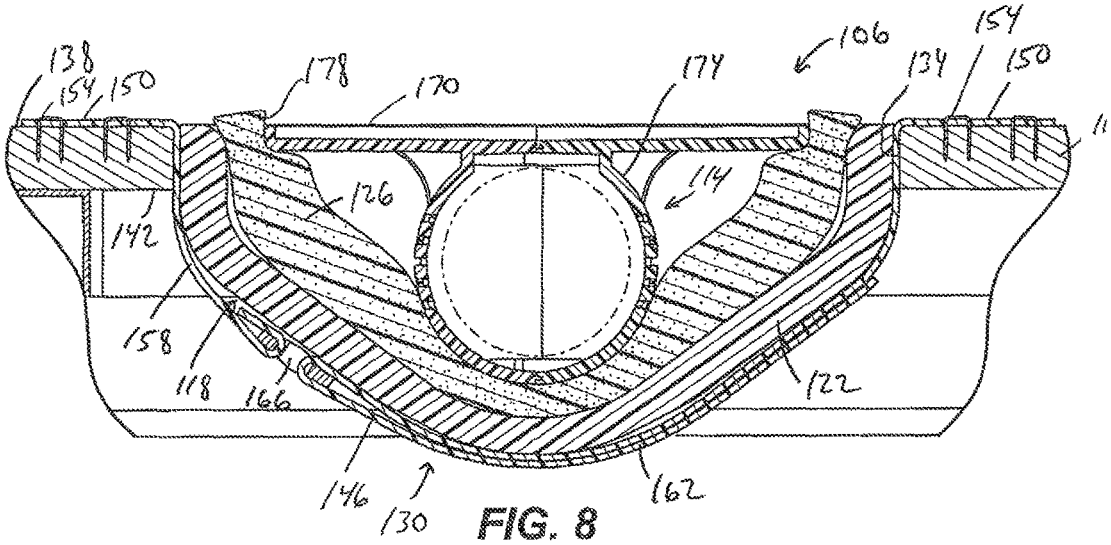
FIG. 8 is a cross-sectional view of one of the vibration motor assemblies through line 8-8 in FIG. 6.

With reference to FIGS. 7 and 8, the adjustable mattress foundation 10 includes dual supports 130 suspending the vibration motor assembly 106 relative to the panel 110. Although two supports 130 are shown in FIG. 7, a single support 130 or three or more supports 130 can instead be used as desired. Also, although not shown in their entirety, the foundation 10 includes additional identical supports 130 (FIG. 6) suspending the other vibration motor assemblies 106 to the panels 110. Particularly, the panels 110 include respective apertures 134 through which the vibration motor assemblies 106 are received. Each of the supports 130 extends through the aperture 134 for mounting to a top surface 138 of the panel 110. Alternatively, the supports 130 may extend through the aperture 134 for mounting to an upper surface, of the panel 110 not coinciding with the top surface 138. For example, the supports 130 may be mounted to a notched, upper surface or upwardly facing surface of the panel 110 between the top surface and a bottom surface 142 (FIG. 8) of the panel 110.

With reference to FIGS. 7 and 8, the supports 130 are configured as flexible straps 146 each having opposed ends 150 attached to the top surface 138 of the panel 110. In the illustrated embodiment of the adjustable mattress foundation 10, the ends 150 of the straps 146 are fastened to the top surface 138 of the panel 110 using staples 154. Alternatively, different fasteners, adhesives, and the like may be utilized to secure the straps 146 to the panel 110. The flexible straps 146 each include an adjustable length to account for slight differences in the size of the foam covers 118 of the vibration motor assemblies 106, although non-adjustable straps 146 can instead be used as desired. In the illustrated embodiment, each strap 146 includes a first segment 158, a second segment 162, and a buckle 166 interconnecting the first and second segments 158, 162. The second segment 162 includes hook and loop fasteners (not shown) to permit a distal, portion of the second segment 162 to be overlaid with and affixed to a proximal portion of the second segment 162.

The illustrated vibration motor 114 includes a flange 170 and a motor housing 174 attached to the flange 170. The flange 170 is generally flat and is located above the motor housing 174 from the frame of reference of FIG. 8. The flange 170 is also positioned within an opening 178 in the cover 118 such that the flange 170 is generally co-planar with the top surface 138 of the panel 110. The adjustable mattress foundation 10 further includes a fabric sheet 182 secured to the top surface 138 of each of the panels 110 (FIG. 6). The sheet 182 is fastened to the top surface 138 of the panels 110 (e.g., using staples 186 or other suitable fasteners or fastening material) and overlies each of the vibration motors 114 to limit an extent to which the covers 118 and the vibration motors 114 of the respective vibration motor assemblies 106 protrude from the apertures 134 in the panels 110. Particularly, in some embodiments the flexible straps 146 may be tightened to exert a clamping force between the vibration motor assemblies 106 and the sheet 182. As such, the vibration motor assemblies 106 are maintained against the underside of the mattress 14, thereby increasing the efficiency of vibration transfer into the mattress 14 and in some cases reducing the amount of vibration being transferred to the panels 110.

Figure 9:
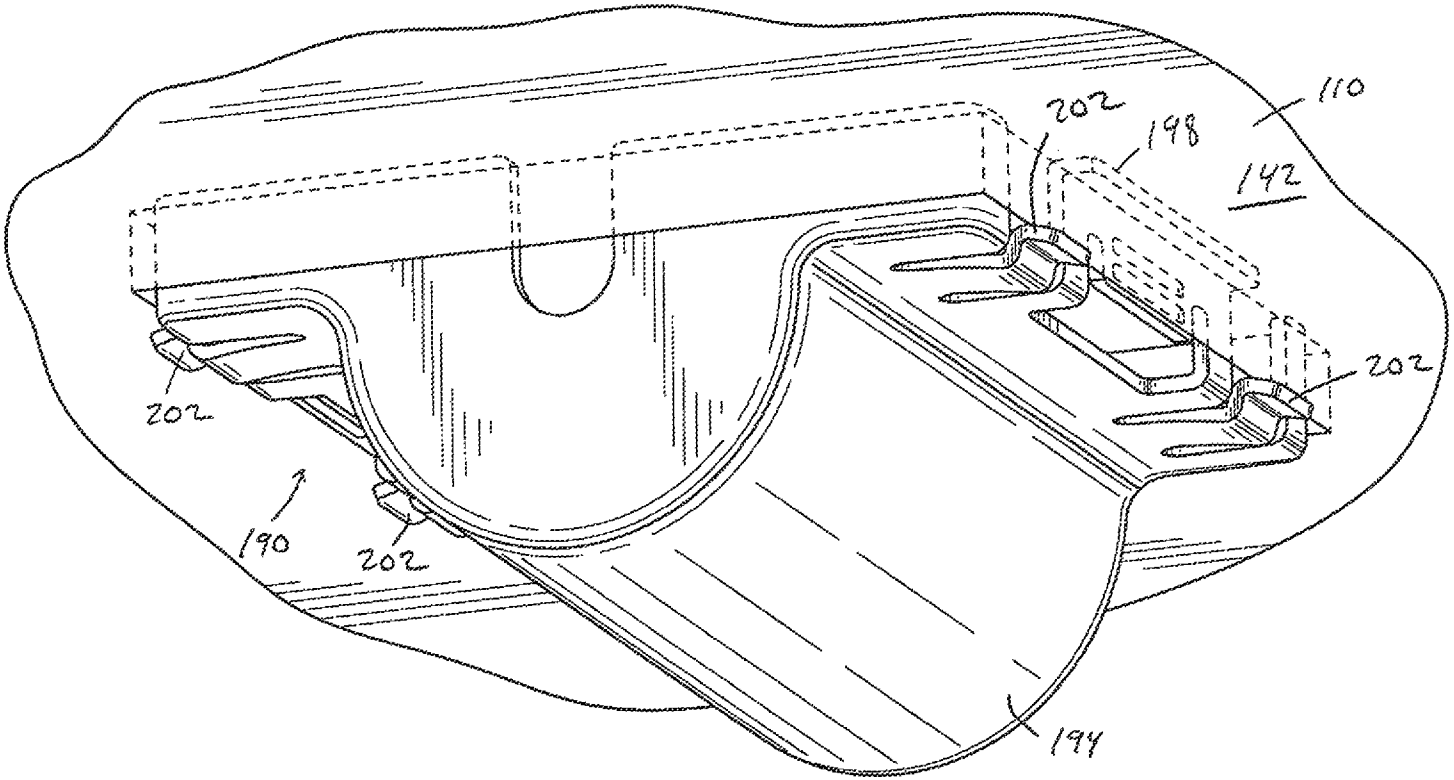
FIG. 9 is a bottom perspective view of an alternative embodiment of the vibration motor assembly of FIG. 7.

FIG. 9 illustrates an alternative embodiment of a vibration motor assembly 190. The assembly 190 includes a rigid plastic cover 194 suspended from the top surface 138 of the panel 110 by opposed tabs 198 (only one of which is shown in FIG. 9). The cover 194 also includes resiliently deflectable fingers 202 that engage the bottom surface 142 of the panel 110 to thereby pinch the panel 110 between the tabs 198 and fingers 202. The tabs 198 and fingers 202 can be integrally formed with the rest of the rigid plastic cover 194.

By virtue of their shape and ability to move with respect to the rest of the rigid, plastic cover 194 (note that the tabs 198 and fingers 202 can extend from adjacent portions of the rigid plastic cover 194 in a cantilevered fashion as shown), the tabs 198 and fingers 202 can be deflected by a user upon installation of the rigid plastic cover 194 on the panel 110. Particularly, to install the cover 194 (with vibration motor assembly 190 therein) from the underside of the panel 110, an installer can squeeze the tabs 198 inward to clear the edges of the aperture 134 in the panel 110, and can then insert the cover 194 into the aperture 134 until the fingers 202 contact the underside of the panel 110. In this regard, the clearance between the ends of the tabs 198 and the ends of the fingers 202 can be smaller than the thickness of the panel 110 therebetween, thereby causing the tabs 198 and fingers 202 to remain in deflected states after the rigid plastic cover 194 has been installed in the aperture 134. By virtue of this relationship between the tabs 198 and fingers 202 (collectively also referred to simply as "projections" of the rigid plastic cover 194) and the panel 110, the rigid plastic cover 194 can be tightly secured to the panel 110, with a biasing force exerted by the tabs 198 and fingers 202 against the panel 110. Such a tightly-secured relationship between the rigid plastic cover 194 and the panel 110 can be very desirable in light of the fact that the rigid plastic cover 194 can be subjected to significant vibration over the lifespan of the mattress foundation 110.

Although the cover 194 in the illustrated embodiment is described above as being made of rigid plastic, it will be appreciated that covers constructed of other resilient materials can perform the same or similar functions, and can instead be used. By way of example, the cover 194 can instead comprise aluminum, steel, or other metal, composite materials, and the like.

Figure 10:
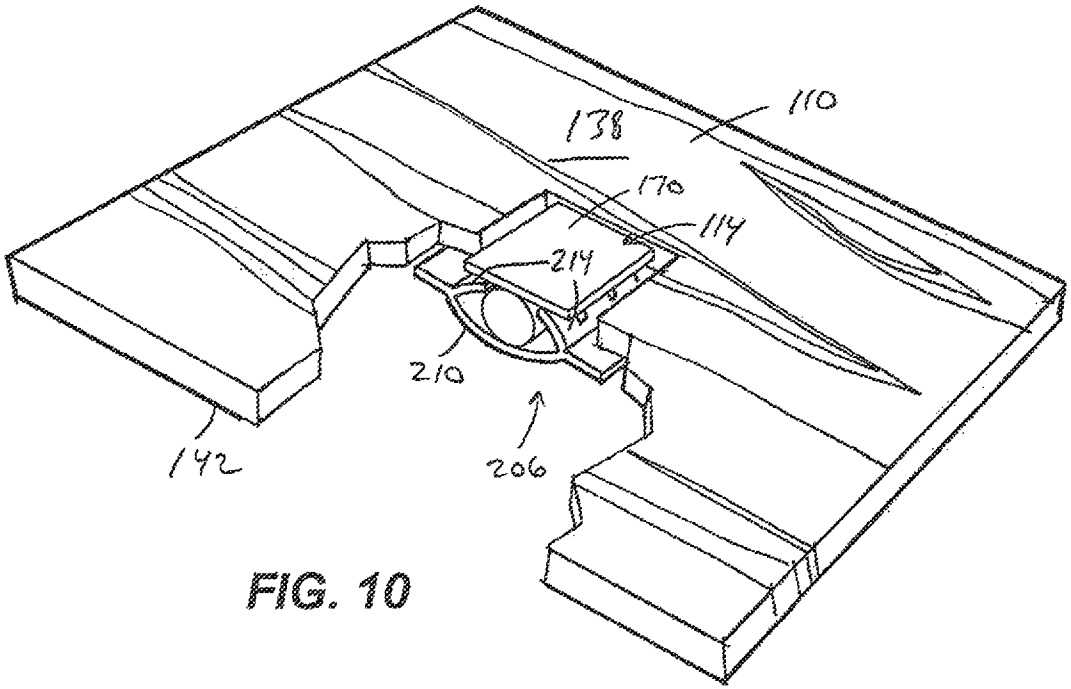
FIG. 10 is a top perspective view of another alternative embodiment of the vibration motor assembly of FIG. 7.
Figure 11:
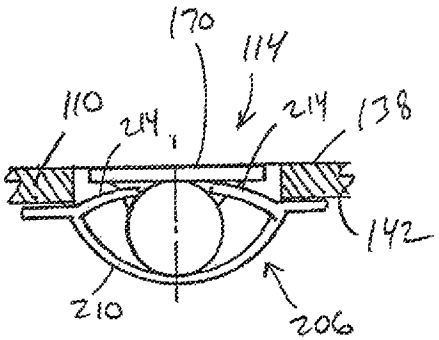
FIG. 11 is a front view of the vibration motor assembly of FIG. 10.

FIGS. 10 and 11 illustrate another alternative embodiment of a vibration motor assembly 206. The assembly 206 includes a cover 210 mounted (e.g., using fasteners, fastening material, and the like) to the bottom surface 142 of the panel 110 and a vibration motor 114 received within a cavity of the cover 210. The cover 210 includes resiliently deflectable fingers 214 that define the upper extent of the cavity. By virtue of their resiliently deformable nature, the fingers 214 exert a clamping force on the vibration motor 114 to tightly hold the vibration motor 114 within the cover 210 while positioning the vibration motor flange 170 in proper relationship in contact with the underside of a mattress (not shown).

FIG. 12 illustrates yet another alternative embodiment of a vibration motor assembly 218. The assembly 218 includes a cover 222 suspended from an upper surface, of the panel 110 and a vibration motor 114 received within a cavity of the cover 222. The cover 222 includes resiliently deflectable fingers 226 that define the upper extent of the cavity. By virtue of their resiliently deformable nature, the fingers 226 exert a clamping force on the vibration motor 114 to tightly hold the vibration motor 114 within the cover 222 while positioning the vibration motor flange 170 in proper relationship in contact with the underside of a mattress (not shown). The cover 222 includes additional tabs 230 adjacent the bottom surface 142 of the panel 110 that cooperate with tabs 230 adjacent the top surface 138 of the panel 110 to hold the cover 222 in place in the panel 110. Although either or both such tabs 230 can be recessed within the adjacent surface 142, 138 of the panel 110, only the upper tabs 230 are recessed within the panel 110 in the illustrated embodiment of FIG. 12.

FIG. 13 illustrates a further alternative embodiment of a vibration motor assembly 234. The assembly 234 includes a cover 238 suspended from an upper surface of the panel 110 and a vibration motor 114 received within a cavity of the cover 238. The cover 238 includes resiliently deflectable fingers 242 that define the upper extent of the cavity. By virtue of their resiliently deformable nature, the fingers 242 exert a clamping force on the vibration motor 114 to tightly hold the vibration motor 114 within the cover 238 while positioning the vibration motor flange 170 in proper relationship in contact with the underside of a mattress (not shown). Like the upper tabs 230 in the embodiment of FIG. 12, the cover 238 also has upper tabs that are recessed within the adjacent surface 138 of the panel 110.

FIG. 14 illustrates another alternative embodiment of a vibration motor assembly 246. The assembly 246 includes a cover 250 suspended from the panel 110 and a vibration motor 114 received within a cavity of the cover 250. The cover 250 includes resiliently deflectable fingers 254 that define the upper extent of the cavity. By virtue of their resiliently deformable nature, the fingers 254 exert a clamping force on the vibration motor 114 to tightly hold the vibration motor 114 within the cover 250 while positioning the vibration motor flange 170 in proper relationship in contact with the underside of a mattress (not shown). The cover 250 includes laterally extending tabs 258 that are received within corresponding slots or grooves 262 in the middle of the panel 110 for suspending the cover 250 from the panel 110.

FIG. 15 illustrates yet another alternative embodiment of a vibration motor assembly 266. The assembly 266 includes a cover 270 suspended from an upper surface of the panel 110 and a vibration motor 114 received within a cavity of the cover 270. The cover 270 includes resiliently deflectable fingers 274 that define the upper extent of the cavity. By virtue of their resiliently deformable nature, the fingers 274 exert a clamping force on the vibration motor 114 to tightly hold the vibration motor 114 within the cover 270 while positioning the vibration motor flange 170 in proper relationship in contact with the underside of a mattress (not shown). In the illustrated embodiment of FIG. 15, the lower extent of the cavity is defined by a convex surface 278 of the cover 270, thereby providing a reduced amount of contact between the cover 270 and the vibration motor 114. In this manner, the cover 270 can exhibit vibration reduction characteristics in order to prevent unwanted transmission of vibration to the panel 110.

FIG. 16 illustrates a further alternative embodiment of a vibration motor assembly 282, with the vibration motor omitted for clarity. The assembly 282 includes a cover 286 including multiple stirrups 290 upon which the vibration motor is supported and resiliently deflectable fingers 294 that engage the vibration motor. By virtue of their resiliently deformable nature, the fingers 294 exert a clamping force on the vibration motor to tightly hold the vibration motor within the cover 286 while positioning the vibration motor flange 170 in proper relationship in contact with the underside of a mattress (not shown). The cover 286 may be mounted to either the top or bottom surface of the panel (not shown).

Figure 17:
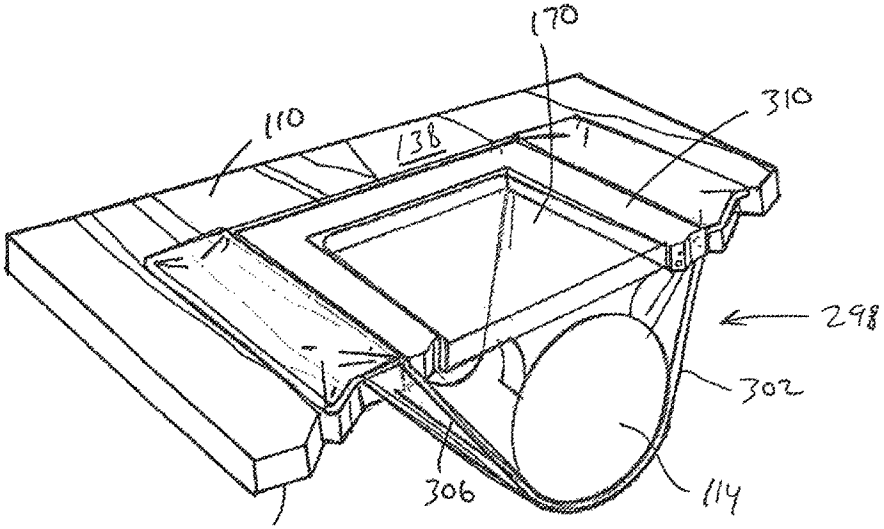
FIG. 17 is a cutaway front perspective view of a further alternative embodiment of the vibration motor assembly of FIG. 7.

FIG. 17 illustrates another alternative embodiment of a vibration motor assembly 298. The assembly 298 includes a cover 302 suspended from an upper surface of the panel 110 and a vibration motor 114 supported by the cover 302 made of a sheet of material (e.g., fabric, plastic, and the like). The cover 302 is configured as an elastic sling 306 to allow the vibration motor 114 to float with respect to the panel 110. As such, the amount of vibration transferred to the panel 110 is reduced. A collar 310 is positioned around the flange 170 of the vibration motor 114 to center the vibration motor 114 within the sling 306 and to inhibit lateral shifting of the vibration motor 114 within the sling 306.

Figure 18:
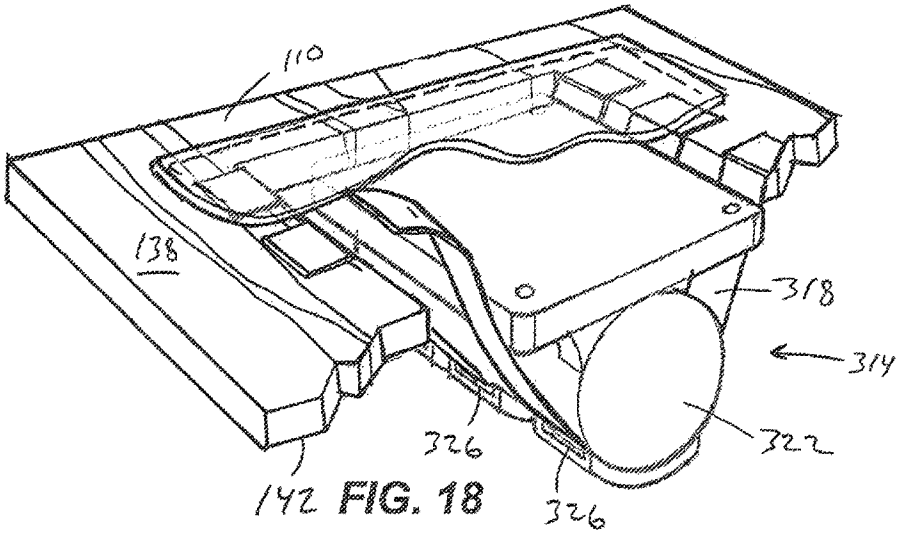
FIG. 18 is a cutaway front perspective view of another alternative embodiment of the vibration motor assembly of FIG. 7.

FIG. 18 illustrates yet another alternative embodiment of a vibration motor assembly 314. The assembly 314 includes multiple elastic straps 318 suspended from the top surface 138 of the panel 110 and a vibration motor 322 supported by the straps 318. In a similar manner as the elastic sling 306 in FIG. 17, the straps 318 allow the vibration motor 322 to float with respect to the panel 110. As such, the amount of vibration transferred to the panel 110 is reduced. The straps 318 can be threaded through corresponding slots 326 in the vibration motor 322 to center the vibration motor 322 within the straps 318 and to inhibit lateral shifting of the vibration motor 322.

Figure 19:
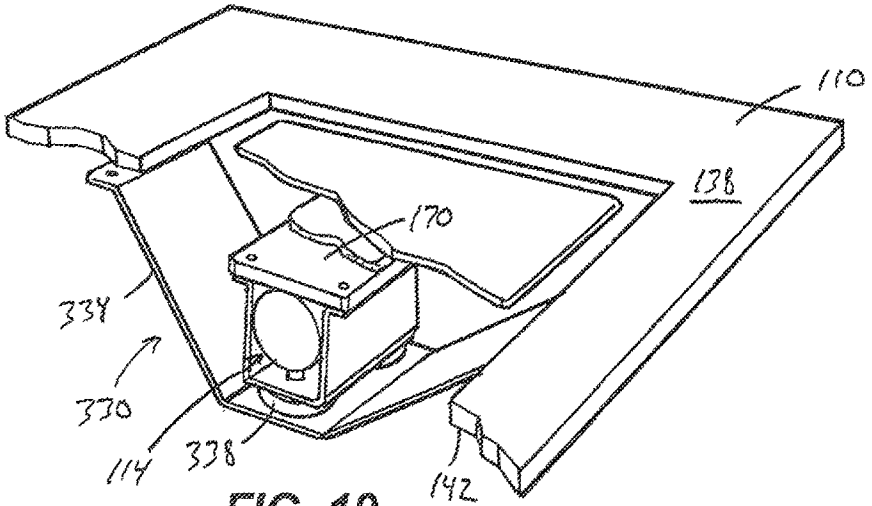
FIG. 19 is a cutaway front perspective view of yet another alternative embodiment of the vibration motor assembly of FIG. 7.

FIG. 19 illustrates a further alternative embodiment of a vibration motor assembly 330. The assembly 330 includes a rigid cover 334 mounted to the bottom surface 142 of the panel 110 and a vibration motor 114 received within a cavity of the cover 334. Vibration isolators 338 (e.g., gel isolators) are utilized to reduce the transfer of vibration from the vibration motor 114 to the cover 334 and the attached panel 110, whereas vibration is transmitted upward from the vibration motor flange 170 to a mattress upon the panel 110.

Figure 20:
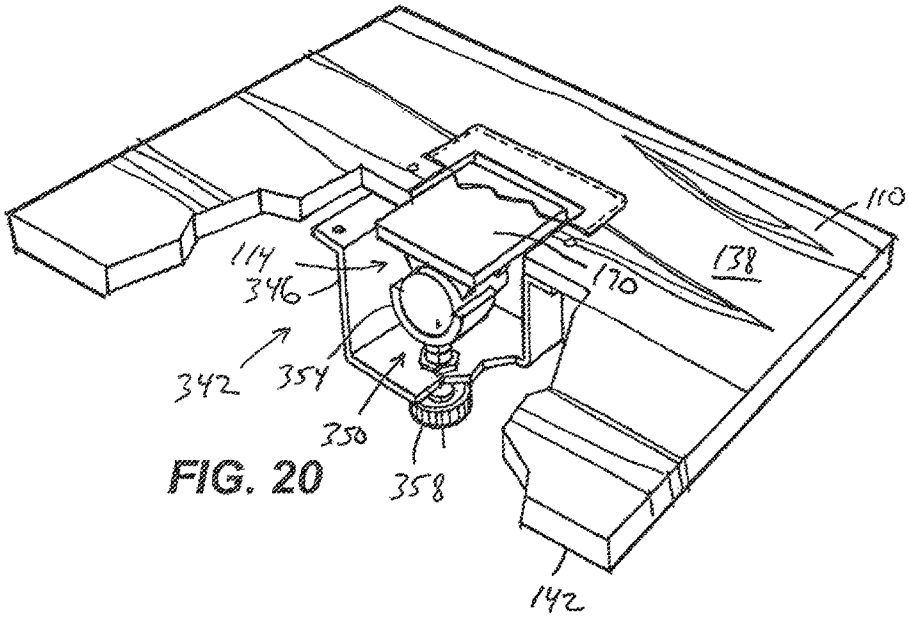
FIG. 20 is a cutaway front perspective view of another alternative embodiment of the vibration motor assembly of FIG. 7.

FIG. 20 illustrates another alternative embodiment of a vibration motor assembly 342. The assembly 342 includes a rigid cover 346 mounted to the bottom surface 142 of the panel 110 and a vibration motor 114 received within a cavity of the cover 346. The assembly 342 also includes an adjustment mechanism 350 positioned between the cover 346 and the vibration motor 114 for varying the spacing between the vibration motor 114 and the overlying mattress 14, thereby enabling an installer or user to vary the resultant intensity of vibration transferred to the mattress 14. The adjustment mechanism 350 includes, for example, a stirrup 354 in which the vibration motor 114 is seated and a knob with setscrew 358 threaded to the cover 346 for raising and lowering the stirrup 354 and the motor 114 relative to the mattress 14.

Figure 21:
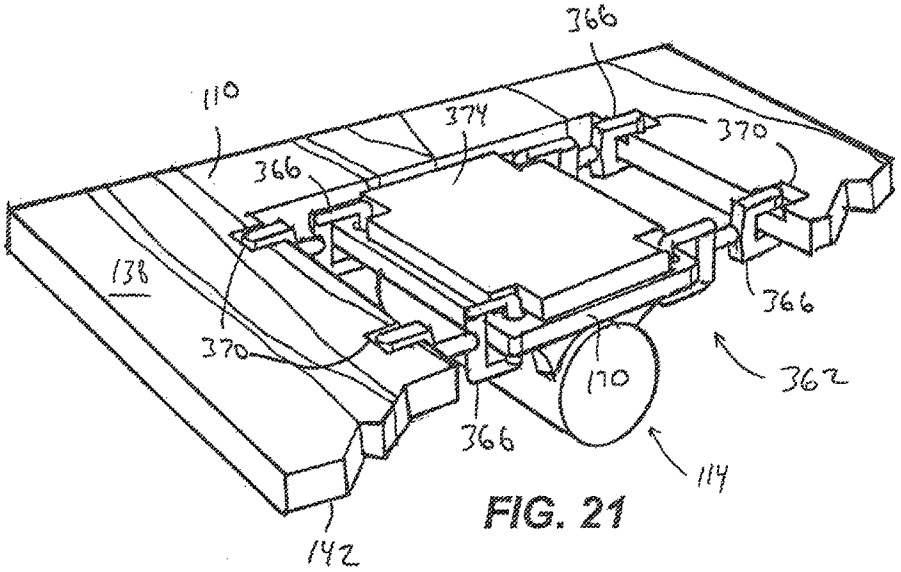
FIG. 21 is a cutaway front perspective view of yet another alternative embodiment of the vibration motor assembly of FIG. 7.

FIG. 21 illustrates yet another alternative embodiment of a vibration motor assembly 362. The assembly 362 includes a vibration motor 114 and multiple clamps 366 securing the vibration motor 114 to the panel 110. Particularly, the clamps 366 attach to the vibration motor 114 through existing holes in the flange 170. The panel 110 includes a corresponding number of notches 370 in which the clamps 366 are received to make the clamps 366 flush with the top surface 138 of the panel 110. A riser pad 374 may be utilized on the flange 170 to account for any gap between the flange 170 and the top surface 138 of the panel 110.

Figure 22:
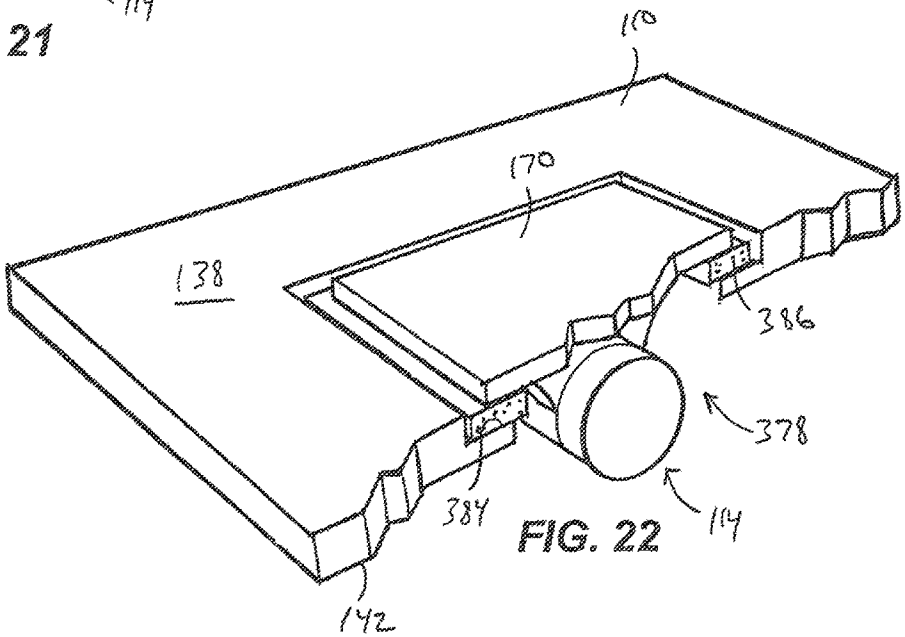
FIG. 22 is a cutaway front perspective view of a further alternative embodiment of the vibration motor assembly of FIG. 7.

FIG. 22 illustrates a further alternative embodiment of a vibration motor assembly 378. The assembly 378 includes a vibration motor 114 suspended from an upper recessed surface 384 of the panel 110 about a periphery of the aperture in the panel 110 and a foam isolator 386 positioned between the flange 370 of the vibration motor 114 and the upper recessed surface 384 of the panel 110. The foam isolator 186 attenuates the magnitude of vibration transferred to the panel 110.

Figure 23:
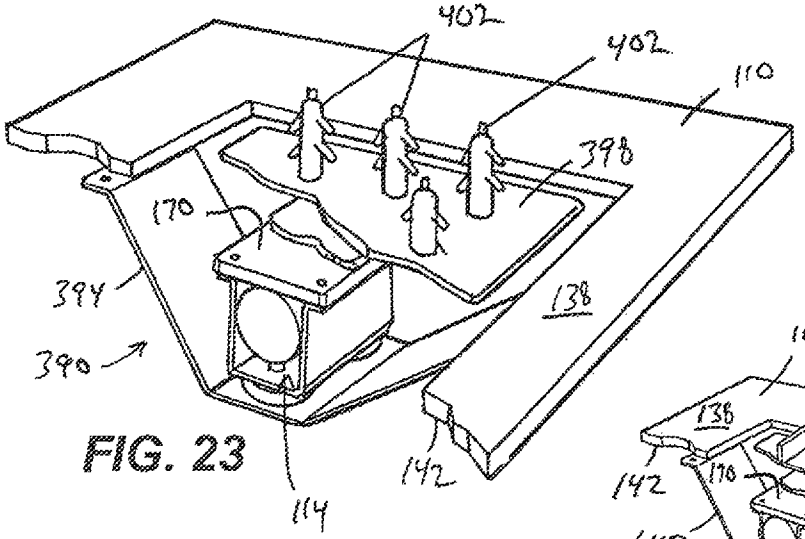
FIG. 23 is a cutaway front perspective view of another alternative embodiment of the vibration motor assembly of FIG. 7.
Figure 24:
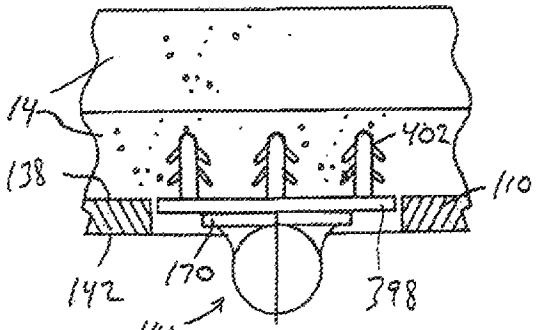
FIG. 24 is a front view of the vibration motor assembly of FIG. 23.

FIGS. 23 and 24 illustrate another alternative embodiment of a vibration motor assembly 390. The assembly 390 includes a rigid cover 394 mounted to the bottom surface 142 of the panel 110 and a vibration motor 114 received within a cavity of the cover 394. A riser pad 398 with multiple protrusions 402 (each of which has barbs, in the illustrated embodiment) is positioned on the flange 170 of the vibration motor 114, with the protrusions 402 being inserted into the mattress 14. In this manner, vibration from the vibration motor 114 can be transferred to the mattress 14 through the riser pad 398 and the protrusions 402.

Figure 25:
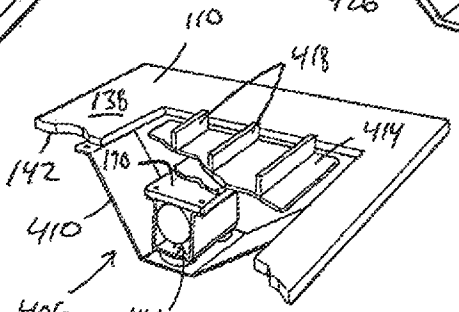
FIG. 25 is a cutaway front perspective view of another alternative embodiment of the vibration motor assembly of FIG. 7.

FIG. 25 illustrates yet another alternative embodiment of a vibration motor assembly 406. The assembly 406 includes a rigid cover 410 mounted to the bottom surface 142 of the panel 110 and a vibration motor 114 received within a cavity of the cover 410. A riser pad 414 with multiple protrusions in the form of ribs 418 is positioned on the flange 170 of the vibration motor 114, with the ribs 418 being inserted into an overlying mattress (not shown). As such, vibration from the vibration, motor 114 can be transferred to the mattress through the riser pad 414 and the ribs 418.

Figure 26:
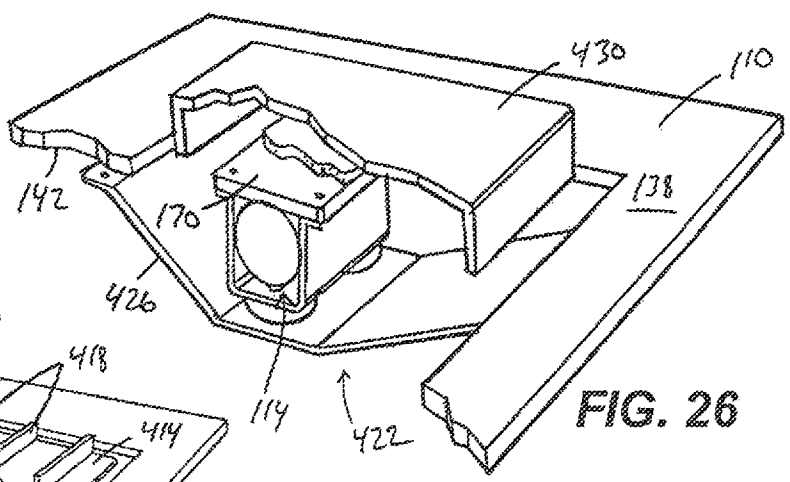
FIG. 26 is a cutaway front perspective view of another alternative embodiment of the vibration motor assembly of FIG. 7.
Figure 27:
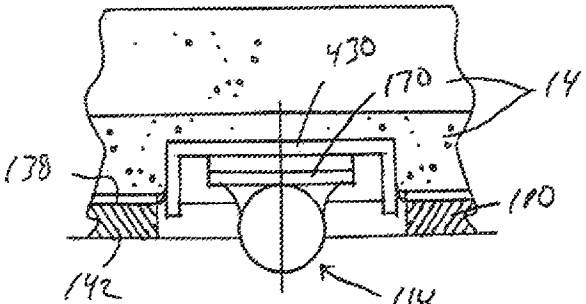
FIG. 27 is a front view of the vibration motor assembly of FIG. 26.

FIGS. 26 and 27 illustrate a further alternative embodiment of a vibration motor assembly 422. The assembly 422 includes a rigid cover 426 mounted to the bottom surface 142 of the panel 110 and a vibration motor 114 received within a cavity of the cover 426. A tray 430 is recessed into the mattress 14, with the vibration motor 114 being received at least partially within the tray 430. As such, vibration from the vibration motor 114 can be transferred red to the mattress 14 through the tray 430.

The vibration motor assemblies, and structures and methods disclosed herein for positioning and/or mounting such vibration motor assemblies have been described and illustrated in connection with adjustable mattress foundations. However, it should be noted that the application of such vibration motor assemblies, and the structures and methods disclosed herein for positioning and/or mounting such vibration motor assemblies is not limited to adjustable mattress foundations. Instead, the use of the vibration motor assemblies, and structures and methods disclosed herein for positioning and/or mounting such vibration motor assemblies in conjunction with non-adjustable mattress foundations is contemplated herein, and forms an aspect of the present invention. Similarly, adjustable mattress foundations as disclosed herein need not necessarily utilize any vibration motor assemblies.

Various features of the invention are set forth in the following claims.

What is claimed is:

1. An adjustable mattress foundation comprising:

a frame including at least one movable frame portion;

a panel coupled for movement with the movable frame portion;

an actuator supported upon the frame and operable to selectively incline the at least one movable frame portion; and a vibration motor assembly coupled to the panel, the vibration motor assembly including a vibration motor and a cover at least partially enclosing the vibration motor, the cover including an outer shell comprised of foam and a liner at least partially positioned within the outer shell; and wherein the outer shell is made of a first foam material, and wherein the liner is made of a second foam material.

2. The adjustable mattress foundation of claim 1, wherein the liner is positioned between the vibration motor and the outer shell.

3. The adjustable mattress foundation of claim 1, wherein the first foam material is more rigid than the second foam material.

4. The adjustable mattress foundation of claim 1, wherein the first foam material is more dense than the second foam material.

5. The adjustable mattress foundation of claim 1, wherein the second foam material attenuates the magnitude of vibration emitted by the vibration motor.

6. The adjustable mattress foundation of claim 1, wherein the first foam material attenuates the magnitude of noise being transferred from the vibration motor to the panel.

7. The adjustable mattress foundation of claim 1, further comprising a support suspending the vibration motor assembly relative to the panel.

8. The adjustable mattress foundation of claim 7, wherein the panel includes a lower surface in facing relationship with the movable frame portion and an upper surface, and wherein the support is mounted to the upper surface of the panel.

9. The adjustable mattress foundation of claim 8, wherein the support is a flexible strap having opposed first and second ends attached to the upper surface of the panel.

10. The adjustable mattress foundation of claim 9, wherein a length of the flexible strap is adjustable.

11. The adjustable mattress foundation of claim 10, wherein the flexible strap includes a first segment, a second segment, and a buckle interconnecting the first and second segments.

12. The adjustable mattress foundation of claim 9, wherein the flexible strap is a first flexible strap, and wherein the adjustable mattress foundation further includes a second flexible strap having opposed first and second ends attached to the upper surface of the panel.

13. The adjustable mattress foundation of claim 9, wherein the first and second ends of the flexible strap are stapled to the upper surface of the panel.

14. The adjustable mattress foundation of claim 9, wherein the upper surface of the panel coincides with a top surface of the panel.

15. The adjustable mattress foundation of claim 1, wherein the panel includes an aperture, and wherein the cover is at least partially received within the aperture.

16. The adjustable mattress foundation of claim 15, wherein the vibration motor includes a flange and a motor housing attached to the flange, and wherein the flange is located above the motor housing.

17. The adjustable mattress foundation of claim 16, wherein the cover includes an opening, and wherein the flange is positioned in the opening.

18. The adjustable mattress foundation of claim 15, further comprising a sheet secured to an upper surface of the panel, wherein the sheet at least partially overlies the vibration motor to limit an extent to which the cover and the vibration motor protrude from the aperture in the panel.

19. The adjustable mattress foundation of claim 18, wherein the sheet is stapled to the upper surface of the panel.

20. The adjustable mattress foundation of claim 18, further comprising a support suspending the vibration motor assembly relative to the panel, wherein the support clamps the vibration motor assembly against the sheet.

21. The adjustable mattress foundation of claim 15, wherein the sheet is made of a fabric material.

22. An adjustable mattress foundation comprising:

a frame including at least one movable frame portion;

a panel coupled for movement with the movable frame portion;

an actuator supported upon the frame and operable to selectively incline the at least one movable frame portion; and a vibration motor assembly coupled to the panel, the vibration motor assembly including a vibration motor and a cover at least partially enclosing the vibration motor, the cover including an outer shell comprised of foam and a liner at least partially positioned within the outer shell; and wherein the liner is adhesively coupled to the outer shell.

23. An assembly for generating vibration of a mattress supported upon a panel of a mattress foundation, the panel having an aperture therein, the assembly comprising:

a vibration motor; and a cover at least partially enclosing the vibration motor, the cover coupled to the panel and suspending the vibration motor in a position substantially aligned with the aperture in the panel and located at least partially below the panel, the cover comprising an outer shell adapted to be coupled to the panel proximate the aperture;

and a liner at least partially positioned within the outer shell between the vibration motor and the outer shell;

wherein the outer shell is formed of a first foam and the liner is formed of a second foam.

24. A mattress foundation comprising:

a frame;

a panel supported by the frame and adapted for support of a mattress thereon; and a vibration motor assembly coupled to the panel, the vibration motor assembly including a vibration motor and a cover at least partially enclosing the vibration motor, the cover including an outer shell and a liner at least partially positioned within the outer shell wherein the outer shell and the liner are formed of first and second foams, respectively.

* * * * *